United States Patent [19]

Sequin et al.

[11] Patent Number: 4,612,535

[45] Date of Patent: Sep. 16, 1986

[54] ADD-ON ALERT SYSTEM

[76] Inventors: Kenneth Sequin, Star Rte.; Edward F. Burke, P.O. Box 26, both of Massena, N.Y. 13662

[21] Appl. No.: 667,341

[22] Filed: Nov. 1, 1984

[51] Int. Cl.[4] ..... G08B 1/08

[52] U.S. Cl. ..... 340/539; 340/531; 340/628; 340/384 E; 367/199

[58] Field of Search ..... 340/539, 531, 521, 628, 340/384 R, 384 E; 367/197–199

[56] References Cited

U.S. PATENT DOCUMENTS 3,930,246 12/1975 Campbell ..... 340/539

4,091,366 5/1978 Lavallee ..... 340/539

4,363,031 12/1982 Reinowitz ..... 340/539

4,387,368 6/1983 Day, III et al. ..... 340/539

*Primary Examiner*—Donnie L. Crosland

*Attorney, Agent, or Firm*—Bruns and Wall

[57] ABSTRACT

An add-on alarm system for use in conjunction with an audio detector. The system includes an indoor unit that is audibly coupled to the detector and an outdoor unit containing an independent power supply that communicates with the indoor unit to provide an alert signal for directing rescue operations. The outdoor unit includes a relay which is energized by a signal from the indoor unit to close a contact in an alarm circuit and thus generate an alert signal. The relay is held energized by the outdoor power supply so that the alert signal persists in the event the detector or the indoor unit becomes disabled.

14 Claims, 4 Drawing Figures

ALARM CIRCUIT
LATCHING CIRCUIT
RX
RX
LATCHING CIRCUIT
ALARM CIRCUIT
TX
RELAY CIRCUIT
SIGNAL AMPLIFIER
9VAC
+3V

ADD-ON ALERT SYSTEM

BACKGROUND OF THE INVENTION

This invention relates to an indoor-outdoor emergency warning system and in particular, to an add-on system that is audible coupled to an existing detector to furnish an alarm at a remote location that will aid rescuers in locating the source of the emergency and/or the location of people who might be in need of help.

Many occupied buildings, such as homes, are now equipped with a number of smoke or fire detectors. Each detector services a given region within its particular sensing range and upon detecting a potentially dangerous situation, generates an audible output signal. Some detectors are further equipped with some type of lighting device that is activated upon the sensing of an emergency to illuminate the involved region to find an escape route to safety. Smoke detectors equipped with lighting devices are described in further detail in U.S. Pat. Nos. 4,148,023; 4,257,039; 4,258,291 and 4,287,509. These devices, however, all suffer from one serious drawback in that the equipment is contained entirely inside the building within the danger zone. As a consequence, the equipment itself is usually consumed by the fire, and thus ceases to function after what might be a relatively short period of time. Furthermore, because the warning equipment is entirely contained inside the building, it is of little use in alerting people outside the building who might aid in combating the fire and/or rescuing those in the house such as children or invalids who typically are in need of such aid. When help does arrive, the rescuer generally has no way of knowing which parts of the building are most heavily involved and even more importantly, finding which areas are normally occupied by children, invalids or the like.

SUMMARY OF THE INVENTION

It is therefore an object of the present invention to improve warning systems and in particular fire warning systems that utilize smoke or fire detectors for furnishing an audible output signal.

A further object of the present invention is to provide an add-on warning system for use in association with an existing fire and/or smoke detector that is capable of generating a secondary alert signal or signals at a remote location.

A still further object of the present invention is to provide an add-on alert system for use in conjunction with an existing smoke or fire detector that transmits a radio signal to an outdoor battery operated receiver which, in response thereto, generates both an audio and a visual alarm signal capable of indicating to rescuers the general location of the emergency within the building.

Another object of the present invention is to provide an independently powered unit that can be audibly coupled to an existing smoke or fire detector and furnish a warning signal at a remote location that will persist in the event the detector is destroyed by fire or the like.

Yet another object of the present invention is to provide additional information to rescuers of the location of typically occupied areas of a building that are involved in a fire or some other potentially dangerous emergency.

These and other objects of the present invention are attained by means of an emergency signaling unit that includes a detector located inside of a building for generating an audible signal when an emergency condition is sensed within the sensing range of the detector. An audio pick up is located in close proximity with the detector and is optically coupled to a relay which is energized when the detector generates an audible output signal. An alarm unit is located outside the building which includes its own power supply and a contact which is closed upon energization of the relay thereby enabling an alarm circuit. The relay is electrically connected to the outdoor unit power supply so that it will remain energized once the contact is closed, thus holding the alarm circuit enabled regardless of the condition of the detector. The outdoor alarm circuit is located adjacent to the indoor area serviced by the detector to assist those responding to the alarm in rescue operations.

BRIEF DESCRIPTION OF THE DRAWING

For a better understanding of these and other objects of the present invention, reference is had to the following detailed description of the invention which is to be read in conjunction with the accompanying drawings, wherein.

DESCRIPTION OF THE INVENTION

Figures 1, 4:
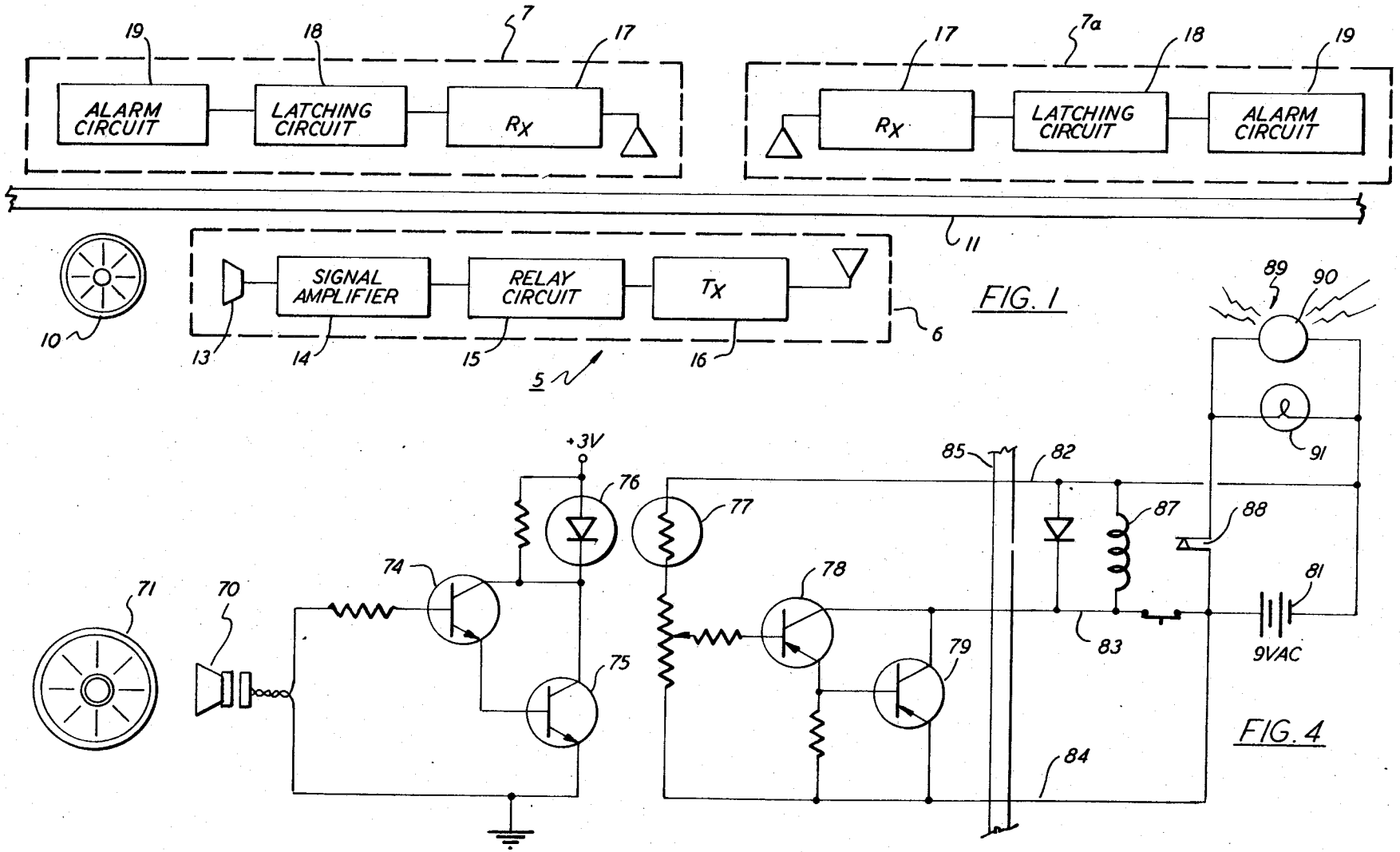
FIG. 1 is a block diagram showing one embodiment of the invention wherein the emergency warning system contains an indoor transmitting unit and an outdoor receiver unit that communicate via a radio frequency signal to generate a warning signal on the outside of the building.
FIG. 4 is a circuit diagram of a second embodiment of the invention.

Referring initially to FIG. 1, there is shown in block diagram, an emergency alert and warning system embodying one form of the instant invention. As depicted, the system, generally referenced 5, consists of an indoor unit 6 and one or more outdoor units shown at 7 and **7*a* that are capable of communicating with the indoor unit through a wall 11** of the building being serviced by the system.

The indoor unit is positioned adjacent to an existing smoke and/or fire detector 10 and is audio-coupled thereto via a microphone 13. The detector can be any one of many commercially available devices designed to provide an audible output signal upon sensing a potentially dangerous condition within its sensing range. Typically, in larger buildings or homes, a number of detectors are installed to monitor different areas and thus give an early warning in the event a fire ensues in one of the zones. The microphone is arranged to pick up the audio signal from the detector and, in response thereto, convert the input to an electrical signal which is passed through an amplifier 14 and applied to a holding relay circuit 15. The relay circuit, when energized, will turn on a radio transmitter 16.

Transmitter 16 is tuned to a specific output signal frequency which has been cleared for this purpose by the FCC. The radio signal is capable of being picked up by tuned receivers 17—17 contained in either of the outdoor units 7 and **7*a*. Upon receipt of the radio signal, the receiver will provide an energizing signal to a latching or holding circuit 18 which enables alarm circuit 19. Although not shown in FIG. 1**, each outdoor unit contains its own self contained power supply. As will be explained in greater detail below, the latching circuit functions to operatively connect the alarm circuit to the power supply once a radio signal is received and to hold the alarm active thereafter until it is manually shut down. Accordingly, the outdoor alarm will continue to deliver an alert signal or signals long after the indoor unit has ceased to operate.

The outdoor unit or units are designed to provide fire fighters or rescuers with certain vital information concerning the source of the fire and those areas in the building, such as bedrooms, which are normally occupied by a person or persons. One outdoor unit is preferably located on the outer wall of the building immediately adjacent to the area monitored by the detector. One or more outdoor units may also be similarly mounted outside those rooms in which a person or persons possibly needing help usually reside. The alarms used in the outdoor units can be coded, either by different sounding audio alarms or different color alert lights, to furnish a clear indication of where the detector is to be found and where generally occupied areas within the building are located. For example, the unit located adjacent the detector equipped zone can contian a red light while units placed near normally occupied areas or rooms can contain blue lights. Accordingly, the red light will signal the probable source of the fire for those fighting the fire and the blue light or lights possible areas that might contain potential victims who might be trapped in the building. Preferably, the outdoor units each include an audio alarm and a visual (light) indicator that can be easily seen at night when many fires go undetected for long periods of time.

Although the present system is ideally suited for use in a home, it can similarly be utilized in hotels, motels, rooming houses, public meeting places and the like to again pinpoint the exact location of an emergency and lead rescuers to usually occupied areas within the building. The present alert system shall be herein described with particular reference to a smoke or fire detector, it can, however, be similarly coupled to any type of detector that is adapted to produce an audible output upon the sensing of the existence of a potentially dangerous situation such as the presence of a toxic gas.

Figure 2:
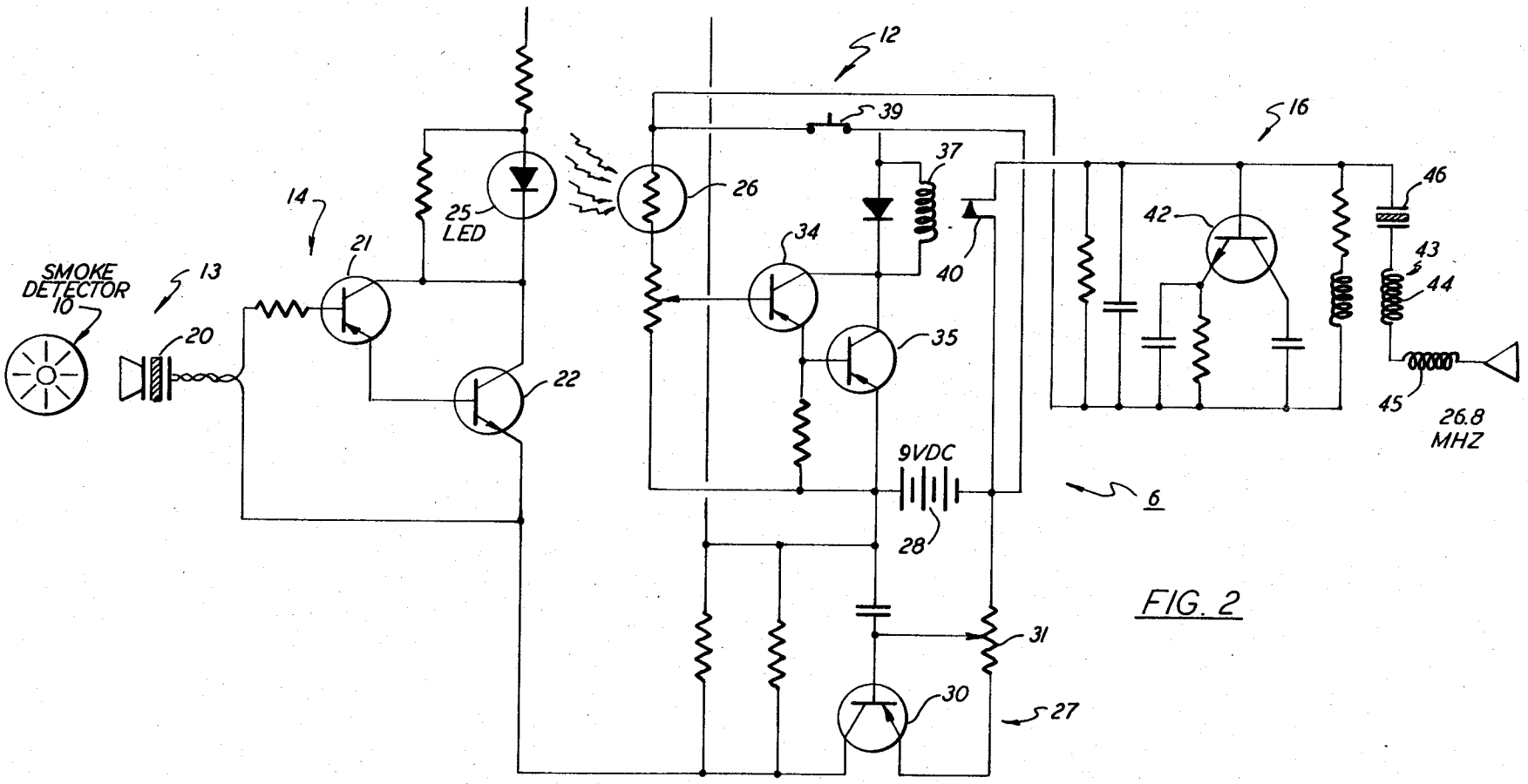
FIG. 2 is a circuit diagram of the indoor unit shown in FIG. 1.
Figure 3:
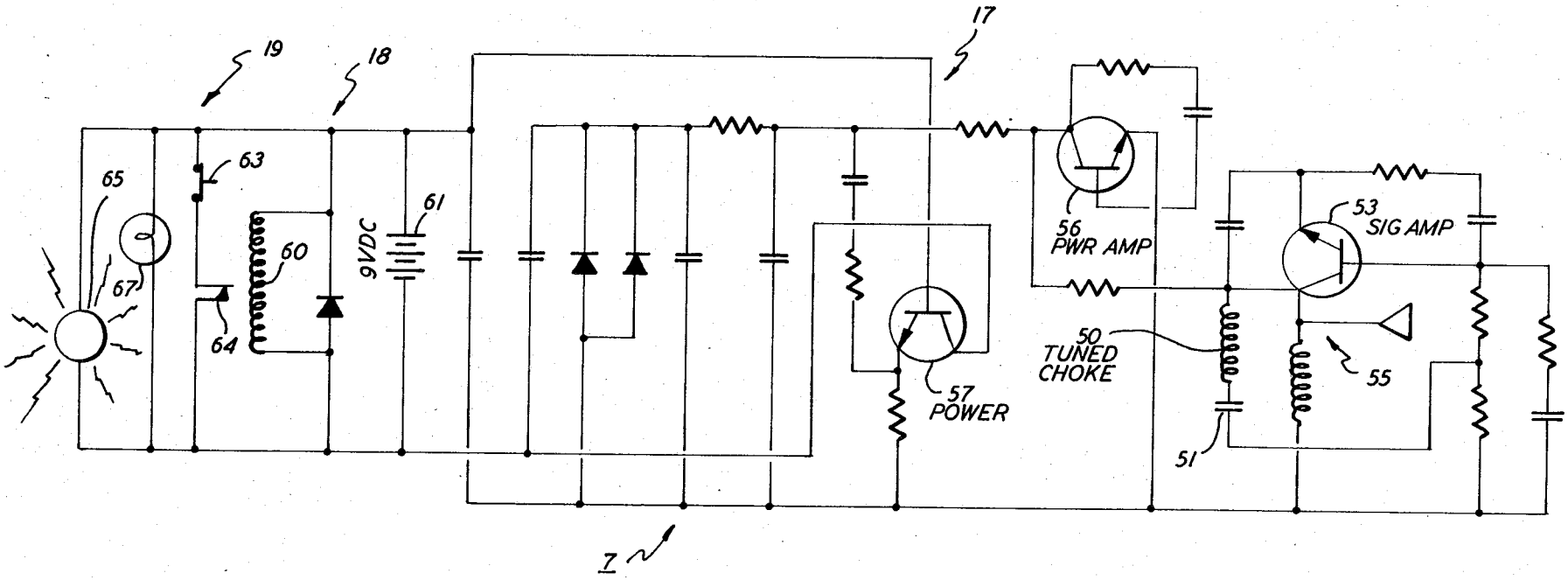
FIG. 3 is a circuit diagram of the outdoor unit shown in FIG. 2.

Turning now more specifically to FIGS. 2 and 3, there is shown circuitry for carrying out the present invention. The indoor unit illustrated in FIG. 2 is located in close proximity with the existing detector 10. The detector is equipped with its own power supply, typically a long life battery, and is adapted to produce a clearly discernable audible signal when an emergency situation is sensed. The microphone 13 is mounted next to the detector to pick up the audio output therefrom. The microphone is a frequency selective device having a high impedance crystal 20 for providing a peak response at about the alarm frequency of the detector. Accordingly, the microphone is able to discern the audio alert signal from background noise and thereby prevent unwanted false alarm signals from being generated. The output of the microphone is coupled to a darlington amplifier network made up of transistors 21 and 22 to convert the audio input into an electrical output signal. The output of the amplifier is coupled to the base of light emitting diode (LED) 25 which is, in turn, optically coupled to photosensitive cell 26 to form an optical isolator for coupling the microphone to the downstream circuits. Power for operating the darlington amplifier and the LED is provided by a voltage regulator circuit generally indicated at 27.

The voltage regulator is placed over a 9 volt DC battery 28 located in relay circuit 15, the function of which will be explained in greater detail below. The voltage regulator includes a forward biased transistor 30, the base of which is connected to a potentiometer 31 which adjustably controls the output of the regulator. The potentiometer is set to provide about 3 volts to the audio amplifier circuit 14. The regulated voltage is set just below the threshold voltage of the LED 25 so that the LED is normally held inactive. Upon the detection of an audible signal from the detector, the amplifier transistors conduct causing the light emitting diode to illuminate. The photosensitive cell 26, picking up the light emissions from the LED, applies a conducting potential via potentiometer 32 to a second darlington amplifier made up of transistors 34 and 35. The output of the second darlington amplifier is applied to a current sensitive relay 37. Battery 28 is placed over the relay. The 9 volt potential, however, is not sufficient to energize the relay and it will remain inactive until such time as the amplifier conducts. Once energized, the relay will remain in an energized condition until reset switch 39 is manually opened or the indoor unit is destroyed in the fire.

Energizing relay 37 causes contact 40 to be pulled closed and thus provide a path for current to reach transmitter 16 from battery 28. This turns the transmitter on. The transmitter is a low power, short range, device containing a single transistor amplifier 42 for generating an output signal. The antenna section 43 of the transmitter is made up of a pair of induction coils 44, 45 and a crystal 46. The crystal tunes the antenna so that the transmitted signal is at about 26.8 MHz which is within the authorized band for this type of equipment. As can be seen, the transmitter begins broadcasting once the relay 37 is energized and will continue to do so until such time as the transmitting equipment is destroyed or the reset switch 39 is opened manually.

The radio receiver 17 is contained in each outdoor unit. The receiver is adapted to receive radio signals broadcast by the transmitter and convert the radio signals into a signal for energizing a downstream alarm circuit. As illustrated in FIG. 3, the receiver is again of simple well known construction. A coil 50 and a capacitor 51 form a choke in the receiver antenna assembly that permits the receiver to pass the broadcast signal on to signal amplifier 53. The output from amplifier 53 is next passed through a first stage power amplifier 56 and a second stage power amplifier 57. The output of the second stage amplifier is coupled to a current sensitive latching relay 60. The relay is electrically connected to a 9 volt battery 61 which is used to provide power to all the electrical components of the outdoor unit. The threshold potential of the relay is set so that the relay is not energized by the battery. Once energized, however, the battery will hold the relay in an energized state until such time as reset switch 63 is opened. The relay becomes energized upon receipt of an output from the second stage amplifier and, in turn, pulls in contact 64 in the alarm circuit. The alarm circuit contains an audio alarm or horn 65 which is wired in parallel over a warning light 67 to thus provide both an audio and visual output. As can be seen, the relay circuit acts as a latch to hold both signaling devices active once contact 64 is pulled closed. The signal will persist until such time as help arrives.

As can be seen, the present alarm system, has a number of features which operate to prevent the generation of a false alarm signal and which maintain the alarm circuit active once a true emergency condition has been detected. The signaling equipment that is located outside of the building in each outdoor unit is self contained and independently powered so that it is capable of continuously providing an alarm signal once it is triggered by the indoor equipment. Accordingly, in the event the indoor equipment is consumed by a fire, which happens in a great number of cases, the outdoor equipment will remain active as explained above, to signal an emergency and to also help lead rescuers to involved areas that might be occupied by persons in need of aid.

Turning now to FIG. 4, there is shown a simplified embodiment of the present invention in which the indoor equipment is wired to the outdoor equipment thus eliminating the radio communication line. Here again, a crystal tuned microphone 70 is positioned adjacent an existing detector capable of providing an audible signal when it senses an emergency condition. Upon receiving an audible output from the detector, the microphone output is transmitted through a darlington amplifier made up of transistors 74 and 75 to energize LED 76. The LED is optically coupled to a photocell 77 to physically isolate the downstream components. As noted above, energizing the photo isolator causes a signal to be passed through a second darlington amplifier consisting of transistor 78 and 79 located in the amplifier section 80. Power is furnished to the amplifier section by a 9 volt DC battery 81.

The alarm circuit and the noted battery 81 are located on the outside of one of the building walls 85 adjacent to the area serviced by the detector to again provide fire fighters and/or rescuers the interior region of the structure that is involved with the emergency. The exterior components of the alarm section are connected to the interior components by wires 82–84 that are passed through the wall 85 of the building. The output of the amplifier section is applied to a latching relay 87 which, in turn, closes a contact 88 in the alarm circuit 89. This, in turn, applies energizing power to an audio alarm 90 and a warning light 91, both of which as shown are located on the outside of the building.

Once enabled, the two alarms will remain operative so long as the battery provides power to this latching relay coil 87. The alarm circuit will thus remain energized after the indoor components of the system are rendered inoperative by fire or the like. A reset switch 93 is furnished in the alarm circuit so that the alarms can be manually disabled. Additional alert lights may also be wired into the alarm circuit with the additional lights being located at critical regions that are normally occupied. Here again, the lights may be color coded to indicate to rescuers the nature of interior region behind the light.

While this invention has been described with specific reference to the above noted method, it should be clear to one skilled in the art that the invention is not limited by this disclosure.

We claim:

1. In a signaling system of the type having at least one detector for monitoring a zone within a building and producing an audible signal when an emergency condition is sensed, an add-on apparatus for use in conjunction with the detector that includes an indoor unit located in the zone monitored by the detector and at least one outdoor unit located adjacent the monitored zone on the outside of the building, said indoor unit including a microphone mounted in close proximity with the detector for energizing a light emitting element of an optical isolator when the detector produces an audible signal, said optical isolator also having a light-sensitive element, means coupled to the light-sensitive element of the optical isolator for closing a contact when the optical isolator is energized and a radio transmitter connected to a power supply by the contact for providing a radio for broadcasting a radio frequency signal when the contact is closed, and said at least one outdoor unit including a radio receiver for receiving said radio frequency signal from the transmitter and applying an enabling potential from a power supply to an alarm circuit whereby an alarm is energized and a holding circuit for maintaining the alarm energized once the alarm circuit is enabled whereby the alarm persists after the transmitter stops broadcasting.

2. The system of claim 1 that further includes discriminating means associated with said microphone for discerning said audible and applying an amplified signal to the optical isolation.

3. The system of claim 1 wherein the radio transmitter includes tuning means for adjusting the frequency of the broadcasted signal.

4. The system of claim 3 wherein the radio receiver has means for tuning the receiver to the frequency of the broadcast signal.

5. The system of claim 1 wherein the power supply of said outdoor unit is a battery.

6. The system of claim 1 wherein the indoor unit contains a voltage regulator connected to the optical isolator for holding the optical isolator at a potential below its threshold potential and an adjusting means for setting the output of the voltage regulator.

7. The system of claim 1 wherein the alarm of at least one outdoor unit includes an audio alarm and a light which are both enabled when the alarm circuit is energized.

8. The system of claim 7 wherein a plurality of outdoor units are located outside the building and wherein the lights associated with the units are color coded to indicate the location of different zones inside the building.

9. The system of claim 1 that further includes manual means for opening said contact.

10. In an emergency signaling system that includes a detector located inside a building for generating an audible signal when an emergency condition is sensed, an audio pick-up means located in close proximity with the detector inside the building for energizing an optical isolator when an audible signal is generated, a relay means connected to the optical isolator for closing a contact in an alarm circuit located outside the building when the optical isolator is energized, said alarm circuit having an independent power supply connected to an alarm means through said contact whereby the alarm means is enabled when the contact is closed, and holding means for maintaining the alarm means enabled once the contact is closed even if the detector and audio pick-up means are destroyed during said emergency condition.

11. The system of claim 10 that includes a current sensing relay for holding the contact closed after the relay is energized.

12. The system of claim 10 wherein the alarm means includes both a visual and an audible alarm.

13. The system of claim 10 wherein said alarm circuit contains a plurality of alarms located at spaced apart locations outside the building.

14. The system of claim 12 wherein the said spaced apart alarms contain lighting means that are color coded to indicate various zones inside the building.

* * * * *